United States Patent [19]

Matsuyama

[11] 4,438,478

[45] Mar. 20, 1984

[54] POWER SUPPLYING APPARATUS

[75] Inventor: Kouszou Matsuyama, Yokohama, Japan

[73] Assignee: Tokyo Shibaura Denki Kabushiki Kaisha, Kawasaki, Japan

[21] Appl. No.: 406,516

[22] Filed: Aug. 9, 1982

[30] Foreign Application Priority Data

Aug. 10, 1981 [JP] Japan ..... 56-124120

[51] Int. Cl.[3] ..... H01H 47/10

[52] U.S. Cl. ..... 361/152; 307/31; 361/154

[58] Field of Search ..... 361/152, 154, 155, 156; 307/31, 32, 34, 38, 41; 355/14 R; 323/233, 364

[56] References Cited

U.S. PATENT DOCUMENTS 3,846,641 11/1974 Eguchi ..... 307/41

3,852,646 12/1974 Mason ..... 361/154

4,291,358 9/1981 Dettmann et al. ..... 361/154

*Primary Examiner*—Harry E. Moose, Jr.

*Assistant Examiner*—Patrick W. Foster

*Attorney, Agent, or Firm*—Cushman, Darby & Cushman

[57] ABSTRACT

A power supplying apparatus has a control circuit which controls the timing at which at least one electromechanical converting means is connected to a non-regulated power supply, and the timing at which at least one other load is connected thereto. The control of the control circuit is such that the electromechanical converting means is first connected to the non-regulated power supply to instantaneously apply a no-load voltage to the electromechanical converting means. As a result, the electromechanical converting means instantaneously produces a great mechanical force. The subsequent control of the control circuit is such that other loads are further connected to the power supply so as to supply the rated voltage to the loads and to the electromechanical converting means.

5 Claims, 11 Drawing Figures

SIGNAL GENERATED WHEN PRINT KEY IS DEPRESSED

SIGNAL FOR BLADE SOLENDID

SIGNAL FOR MOTOR

SIGNAL FOR FIXER SOLENOID

SIGNALS FOR ALL CHARGERS

SIGNAL FOR MANUSCRIPT TABLE CLUTCH

SIGNAL FOR PAPER SUPPLY CLUTCH 30
28
26
24
0
VOLTAGE
TIME

POWER SUPPLYING APPARATUS

BACKGROUND OF THE INVENTION

The present invention relates to a power supplying apparatus and, more particularly, to a power supplying apparatus which reduces a rise in temperature.

A plurality of loads are connected to the power supply in an image formation apparatus such as an electronic copying machine (to be referred to as a copying machine for brevity hereinafter). The operating timings of these loads are controlled by a suitable means.

An example of such a load is a solenoid for bringing a cleaning blade into contact with and separating it from a photosensitive drum. The cleaning blade serves to scrape off residual developer (toner) on the photosensitive drum after each copying operation. The stroke of the solenoid for bringing the blade into contact with and separating it from the photosensitive drum must be about 0.5 cm. An attraction force of about 0.5 kg is required for this purpose. In order to satisfy this requirement, a solenoid has conventionally been used which has an opening rated voltage of DC 24 V and power consumption of 10 W or more.

However, if a solenoid of such a big capacity is used, the temperature inside the copying machine is raised due to heat generated by the solenoid coil.

In addition, a constant voltage power supply of a big current capacity is required to drive a solenoid of such a big capacity. In a constant voltage power supply incorporating semiconductors as switching regulators, the amount of heat generated increases with an increase in the current capacity.

Since the electrostatic latent image characteristics used in a copying machine are temperature dependent, a power supplying apparatus is desired which is capable of reducing a rise in temperature inside the copying machine to the minimum.

SUMMARY OF THE INVENTION

It is an object of the present invention to provide a power supplying apparatus which is capable of reducing a rise in temperature as compared to conventional power supplying apparatuses.

It is another object of the present invention to provide a power supplying apparatus which requires a smaller capacity to drive an electromechanical converting means as compared to conventional power supplying apparatuses.

It is still another object of the present invention to provide a power supplying apparatus which is compact in size.

It is still another object of the present invention to provide a power supplying apparatus with which the size of an electromechanical converting means for supplying required mechanical force may be reduced as compared to the conventional power supplying apparatuses.

These objects may be achieved by a power supplying apparatus which comprises: transformer means for converting a high voltage into a low voltage; non-regulated power supplying means, connected to an output end of said transformer means, for supplying a no-load voltage higher than a full-load voltage; at least one electromechanical converting means, connected to said non-regulated power supplying means, for instantaneously supplying an output greater than a rated output upon reception of an instantaneous voltage higher than a rated voltage from said non-regulated power supplying means, said at least one electromechanical converting means requiring for its initial operation a mechanical force larger than a mechanical force required in a steady state operation; at least one load means connected to said non-regulated power supply means; and control circuit means, connected to said output end of said transformer means, for supplying a control signal to said at least one electromechanical converting means so as to connect said at least one electromechanical converting means to said non-regulated power supply means so that the voltage close to the no-load voltage may be instantaneously supplied thereto, said control circuit means then supplying a control signal to said at least one load means so as to further connect said at least one load means to said non-regulated power supply means so that a substantially rated voltage may be supplied to said at least one load means and to said at least electromechanical converting means.

According to the present invention, the mechanical force required to start the electromechanical converting means is obtained by application of a no-load voltage from the non-regulated power supply means. For this reason, an electromechanical converting means of a small rated output may be adopted to output a required mechanical force. The rated output of the power supply means for supplying power to the electromechanical converting means may also be reduced. As the rated outputs of these means are reduced, the amount of heat generated thereby will also decrease, and the overall apparatus may be made compact in size.

BRIEF DESCRIPTION OF THE DRAWINGS

By way of example and to make the description clearer, reference is made to the accompanying drawings, in which.

DETAILED DESCRIPTION OF THE PREFERRED EMBODIMENT

Figure 1:
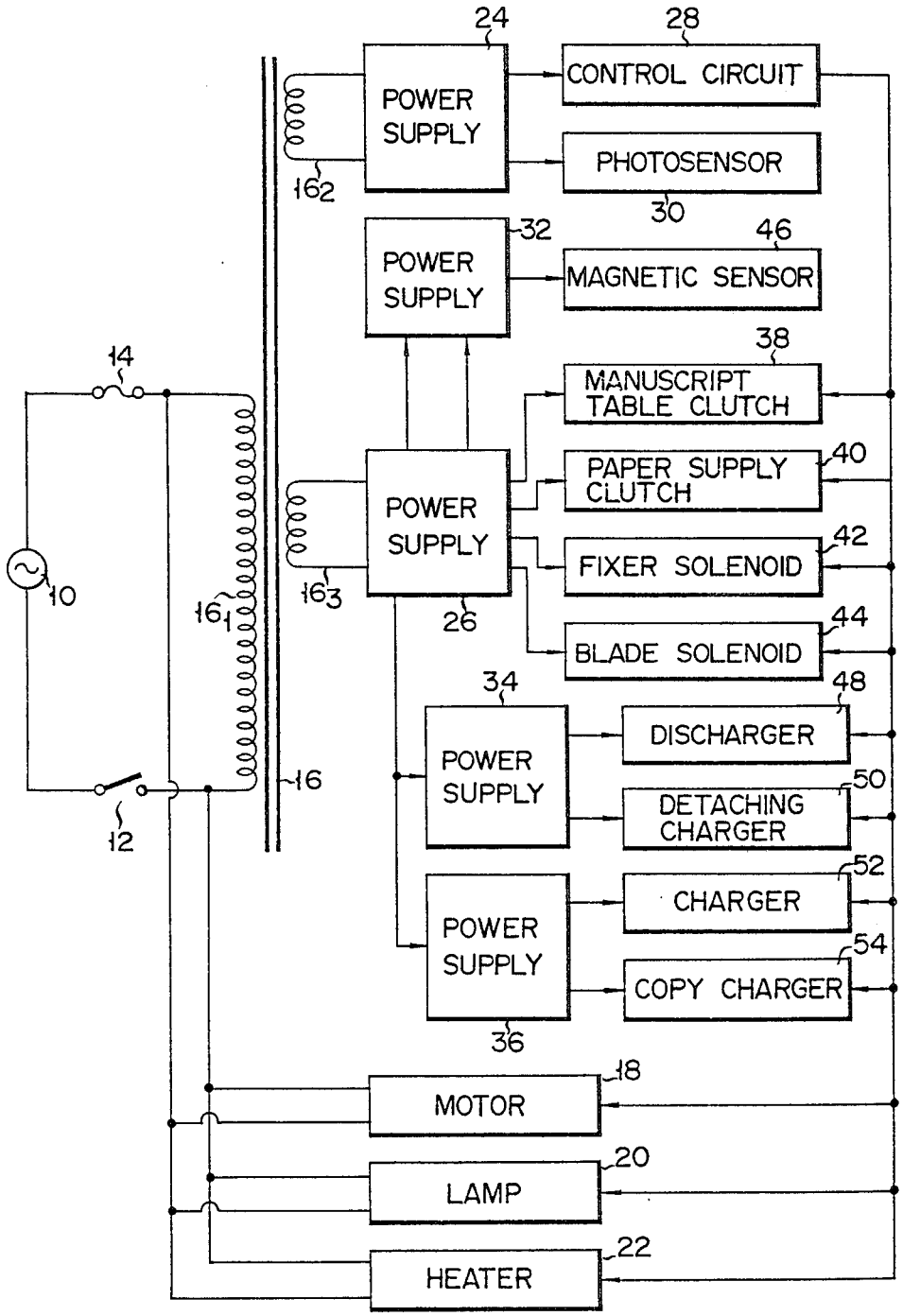
FIG. 1 is a schematic block diagram of an embodiment in which a power supplying apparatus of the present invention is applied to a power supplying apparatus of a copying machine.

FIG. 1 is a schematic block diagram of an embodiment wherein a power supplying apparatus of the present invention is applied to a power supplying apparatus of a copying machine.

A commercial AC outlet 10 of AC 100 V is connected to a transformer 16 through a switch 12 and a fuse 14.

A motor 18, a lamp 20, and a heater 22 as AC loads are connected to a primary winding $16_1$ of the transformer 16. The secondary winding side of the transformer 16 comprises first and second secondary windings $16_2$ and $16_3$. A first power supply 24 is connected to the first secondary winding $16_2$, while a second power supply 26 is connected to the second secondary winding $16_3$. The first power supply 24 serves as a constant voltage power supply of DC 5 V for a logic circuit comprising a control circuit 28 and a photosensor 30 as a load. The second power supply 26 serves as a voltage power supply of DC 24 V. To this second power supply 26 are connected as loads third, fourth and fifth power supplies 32, 34 and 36; a manuscript table clutch 38; a paper supply clutch 40; a fixer solenoid 42 and a blade solenoid 44.

The third power supply 32 is supplied with power from the second power supply 26 and outputs a voltage of DC 18 V. A magnetic sensor 46 is connected as a load to the third power supply 32. The fourth power supply 34 is supplied with power from the second power supply 26 and outputs a voltage of AC 4 kV. A discharger 48 and a detaching charger 50 as loads are connected to the fourth power supply 34. The fifth power supply 36 is supplied with power from the second power supply 26 and outputs a voltage of DC 5.3 kV. A charger 52 and a copy charger 54 as loads are connected to the fifth power supply 36.

Figure 2:
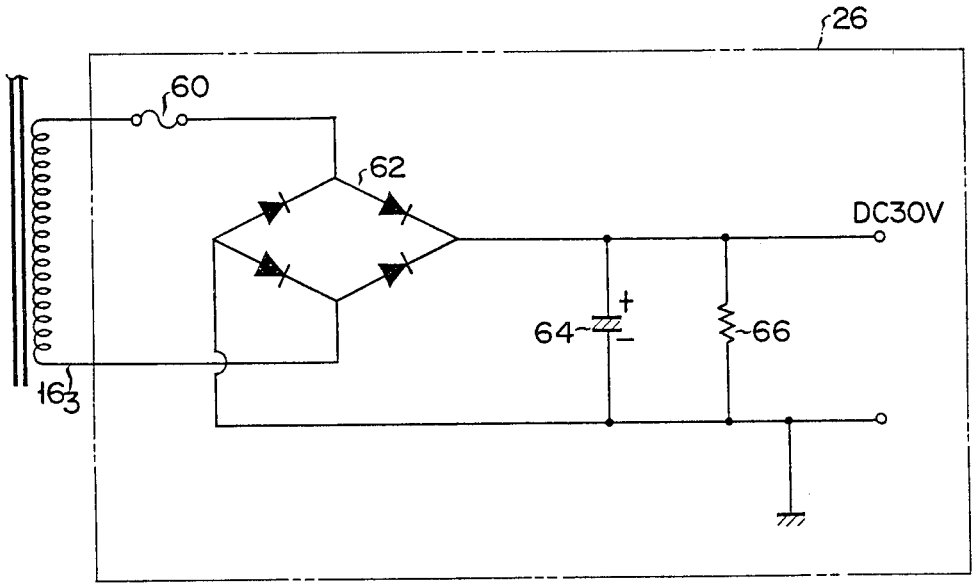
FIG. 2 is a circuit diagram of a second power supply shown in FIG. 1.

FIG. 2 is a circuit diagram of the second power supply 26. As may be seen from the figure, the second power supply 26 comprises a non-regulated power supply.

A diode bridge 62 is connected to the second secondary winding $16_3$ of the transformer 16 through a fuse 60. The diode bridge 62 may comprise four silicon diodes connected in a bridge or packed in a single package. A capacitor 64 is connected to the output end of the diode bridge 62 and serves to filter the pulsed and full-wave rectified current output from the diode bridge 62. In the experiment conducted, an output AC voltage of the second secondary winding $16_3$ of the transformer 16 was 21 V, and an electrolytic capacitor of 6,800 $\mu$F was used as the capacitor 64.

A bleeder 66 is connected in parallel with the capacitor 64. The bleeder 66 allows constant flow of a small current to prevent extreme voltage fluctuations during no-load and load conditions.

Figure 3:
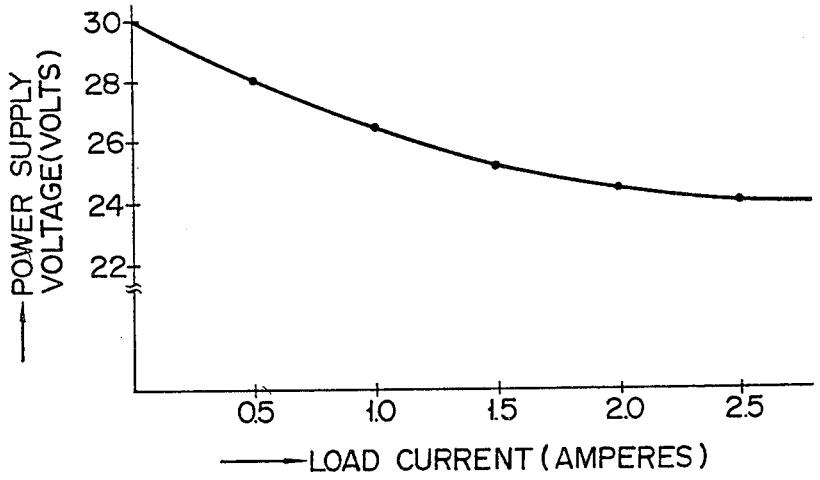
FIG. 3 is a current-voltage characteristic graph of the second power supply shown in FIG. 2.

The second power supply 26 of this configuration has the current-voltage characteristics as shown in FIG. 3. The second power supply 26 produces an output voltage of DC 30 V under the no-load condition. On the other hand, in the full-load condition wherein all the loads of this power supply shown in FIG. 2 are connected, the load current becomes about 2 A and the output voltage is DC 24 V.

Figure 4:
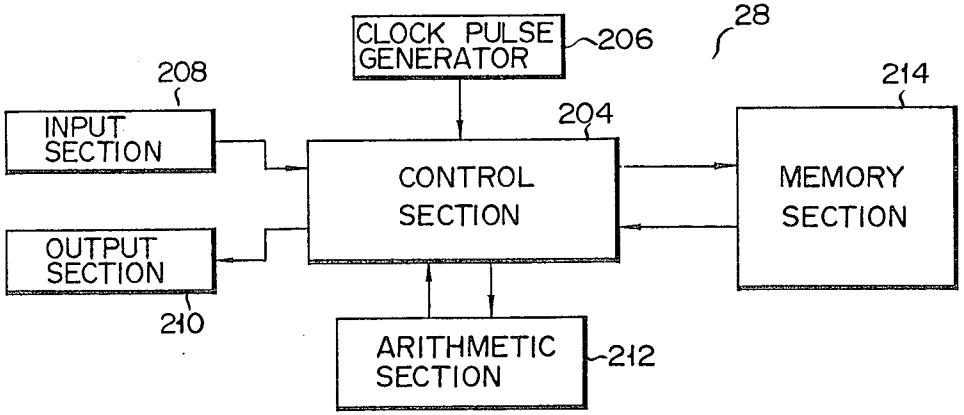
FIG. 4 is a schematic block diagram of a control circuit shown in FIG. 1.

Of the loads described above, the main electromechanical converting means have the operating rated voltages and power consumptions as follows:

(a) Blade solenoid 44: 24 V, 7 W
(When a voltage of 30 V is applied, a current of about 364 mA flows.)
(b) Manuscript table clutch 38: 24 V, 5 W
(c) Paper supply clutch 40: 24 V, 3.6 W
(d) Fixer solenoid 42: 24 V, 5 W FIG. 4 is a schematic block diagram of the control circuit 28. The control circuit 28 has a control section 204, a clock pulse generator 206 connected to the control section 204 for generating clock pulses, an input section 208 for supplying an intput to the control section 204, an output section 208 for receiving an input from the control section 204, an arithmetic section 212 for performing arithmetic operations of data, and a memory section 214 for storing a sequence control program for the copying machine.

As will be described in more detail below, the control circuit 28 supplies control signals to the respective parts shown in FIG. 1.

Figure 5:
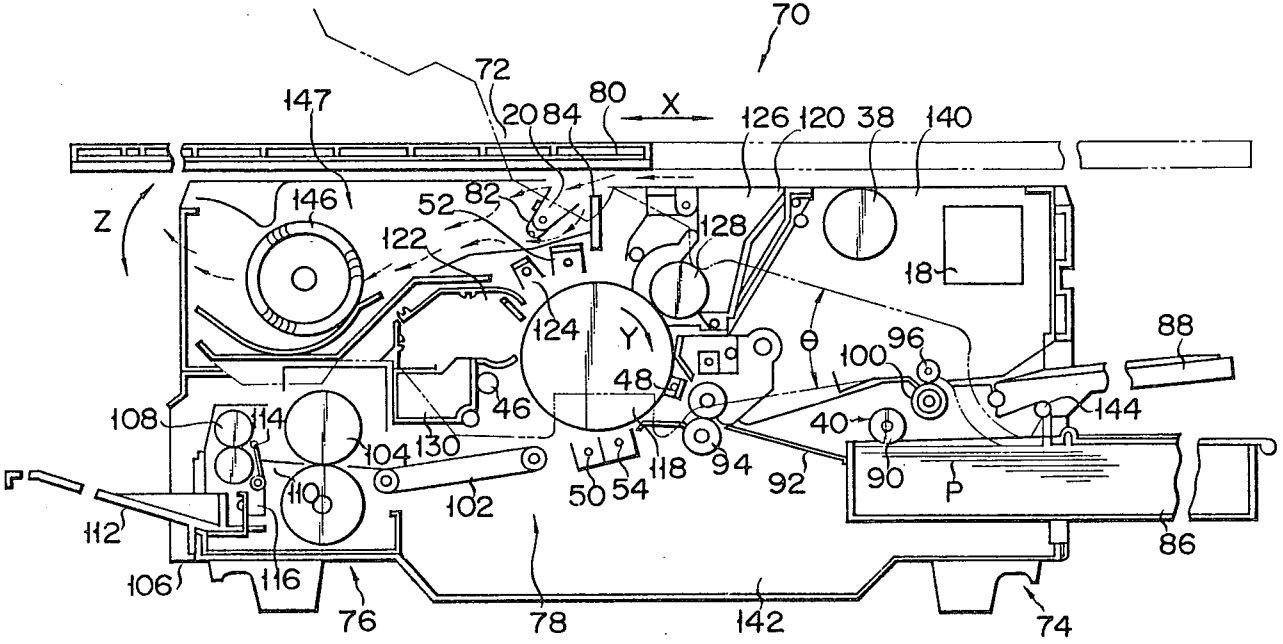
FIG. 5 is a schematic view showing the arrangement of a copying machine incorporating the power supplying apparatus shown in FIG. 1.

FIG. 5 is a schematic view showing the arrangement of a copying machine incorporating the power supplying apparatus of the embodiment described above. The same reference numerals as in FIG. 1 denote the same parts in FIG. 5.

A copying machine 70 comprises an exposure section 72, a paper supply section 74, a delivery section 76, and a copying section 78. These sections of the copying machine 70 are driven by the motor 18.

The exposure section 72 has a manuscript table 80 which reciprocates on the main body of the copying machine 70 in the direction indicated by arrow X. The manuscript table 80 has thereon a transparent platen to receive a manuscript to be copied. The reciprocal movement of the manuscript table 80 is performed by the motor 18 through the clutch 38. Below the lower surface of the manuscript table 80 are arranged a lamp 20 for illuminating the manuscript placed on the table 80, a reflector 82, and an optical waveguide lens 84 for guiding the light reflected from the surface of the manuscript to the copying section 78.

The paper supply section 74 comprises a cassette 86 for storing sheets P on which a copy image is to be formed, a manual paper feed guide 88 for guiding a manually fed sheet P, a pickup roller 90 for picking up a sheet P from the cassette 86, a guide 92 for guiding the sheet P, register rollers 94 for receiving the sheet P through the guide 92, and a guide roller 96 for guiding the sheet P supplied along the manual guide 88 to the register rollers 94.

The pickup roller 90 and the guide roller 96 are driven by the motor 18 through the paper supply clutch 40 and a clutch 100.

The delivery section 76 has a belt 102 for conveying the sheet P with a copy image thereon from the copying section 78, and a fixer 104 for fixing under heat and pressure the image on the sheet P which is conveyed thereto via the belt 102.

A delivery unit 106 is arranged behind the fixer 104. The delivery unit 106 comprises delivery rollers 108, a delivery switch 110 and a delivery tray 112. The delivery switch 110 has a pivotal lever 114 which is pivoted by the sheet P, and a photosensor 116 for detecting the pivotal movement of the pivotal lever 114.

The copying section 78 has a photosensitive member 118 of selenium or the like which is supported to be rotatable in the direction indicated by arrow Y, and a plurality of process units arranged around the outer surface of the photosensitive member 118.

More specifically, along the rotating direction of the photosensitive member 118 are arranged, in the order named, the charger 52, a developing unit 120, the discharger 48, the copy charger 54, the detaching charger 50, a cleaner 122 and a discharger lamp 124.

The charger 52 comprising a DC corona charger which uniformly charges the surface of the photosensitive member 118.

The developing unit 120 has a hopper 126 and a developing roller 128. The hopper 126 holds a one-component magnetic toner. The toner is attached on the surface of the photosensitive member 118 by the developing roller 128 to form a toner image thereon.

The discharger 48 weakens the attaching force of the toner onto the photosensitive member 118 to improve the copy efficiency. The discharger 48 comprises an AC corona charger.

The copy charger 54 transfers the toner image formed on the photosensitive member 118 onto the sheet P. The copy charger 54 comprises a DC corona charger of the same polarity to that of the charger 52.

The detaching charger 50 detaches the sheet P from the surface of the photosensitive member 118 and comprises an AC corona charger.

A cleaner 122 removes the residual toner on the surface of the photosensitive member 118 after transfer. The removed toner is fed to a recovery body 130.

A magnetic sensor 46 for magnetically detecting the amount of the recovered magnetic toner is arranged for the recovery body 130.

The discharger lamp 124 erases the electrostatic latent image remaining on the surface of the photosensitive member 118.

The copying machine 70 of the arrangement as described above is divided into an upper unit 140 and a lower unit 142 by a conveying path of the sheet P, as shown in FIG. 5. The upper unit 140 is pivotally supported about a fulcrum 144 so as to be free to open in the direction indicated by arrow Z. The opened state of the upper unit 140 is shown by the alternate long and two short dashes line.

An evacuation fan 146 is arranged above the delivery unit 106 to discharge heat generated by the exposure section 72 to the exterior of the copying machine through a cooling channel 147. The evacuation fan 146 is incorporated to reduce a rise in temperature inside the copying machine due to a large amount of heat generated by the lamp 20 and to prevent overheat of the optical waveguide lens 84. The flow path of air is shown by the broken line in FIG. 5.

Figure 6:
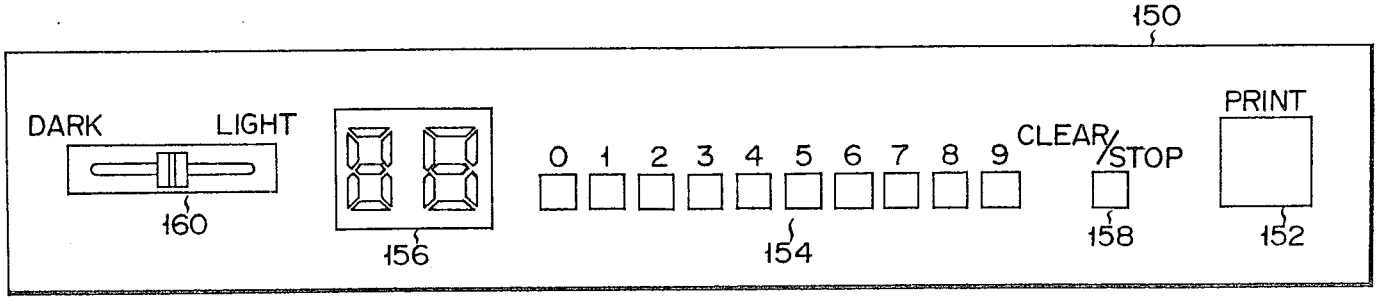
FIG. 6 is a schematic view showing an operation section of the copying machine shown in FIG. 5.

An operation section 150 is arranged on the top surface of the copying machine 70, as shown in FIG. 6. The operation section 159 has a print key 152 for instructing copy start, ten keys 154 for setting the number of copies to be reproduced, an indicator 156 for displaying the entered number of copies to be reproduced, a clear/stop key for clearing the content entered through the ten keys 154 or for stopping the continuous copying operation, and an exposure control key 160 for controlling the exposure.

Figure 7:
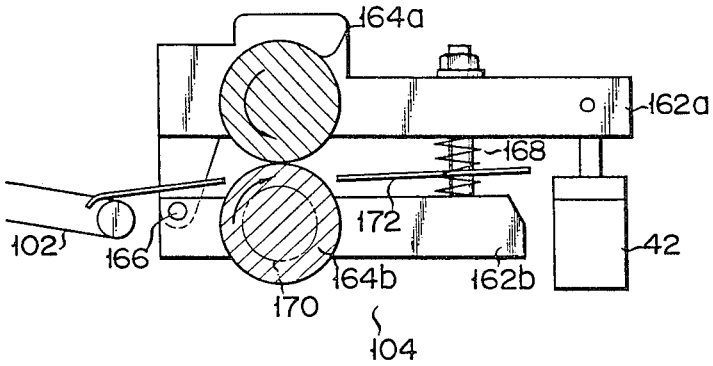
FIG. 7 is a schematic view showing a fixer shown in FIG. 5.

FIG. 7 is a schematic view of a fixer 104 which has heat rollers **164*a* and 164*b* supported on levers 162*a* and 162*b*, respectively. The lever 162*a* is supported, at its one end, to be pivotal with respect to the lever 162*b* at a fulcrum 166 and is biased downward by a spring 168. The fixer solenoid 42 is arranged at the other end of the lever 162*a*. A heating roller 170 serves to heat the heat rollers 164*a* and 164*b*. A guide 172** guides the sheet P.

During the copying operation, the heat rollers **164*a* and 164*b* are biased against each other by the attraction of the blade solenoid 42, as shown in FIG. 7. In the non-copying operation, the blade solenoid 42 is deenergized to pivot the lever 162*a* counterclockwise through the spring 168. As a result, the heat rollers 164*a* and 164*b*** are separated and compression strain is prevented.

Figure 8:
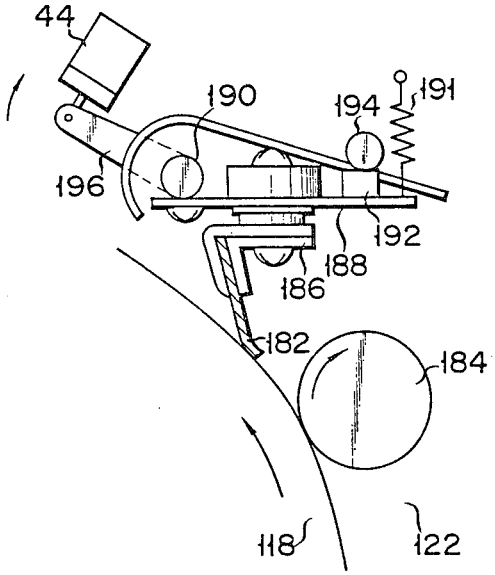
FIG. 8 is a schematic view showing a cleaner shown in FIG. 5.

FIG. 8 is a schematic view of the cleaner 122. A blade 182 and a recovery roller 184 are arranged inside a casing 180.

The blade 182 comprises an elastic body of silicone rubber or the like and is fixed to a holder 186 which is, in turn, fixed to an arm 188. One end of the arm 188 is fixed to one end of a blade shaft 190 for pivotal movement therewith. The other end of the arm 188 is biased upward by a coil spring 191 and is in contact with a stopper 194 through an elastic body 192 mounted on the arm 188.

One end of a link 196 is fixed to the one end of the blade shaft 190. When the link 196 is pivoted by the blade solenoid 44, the blade shaft 190 also pivots.

Since the arm 188 is biased upward by the coil spring 191 in the nonoperative condition, the blade 182 is separated from the surface of the photosensitive member 118. Since the blade solenoid 44 is urged and the link 196 pivots in the direction indicated by the arrow during the copying operation, the arm 188 is pivoted clockwise against the biasing force of the coil spring 191. Then, the blade 182 is urged against the surface of the photosensitive member 118. The toner scraped off by the blade 182 is recovered by the recovery roller 184 and is fed to the recovery box 130.

Figure 9:
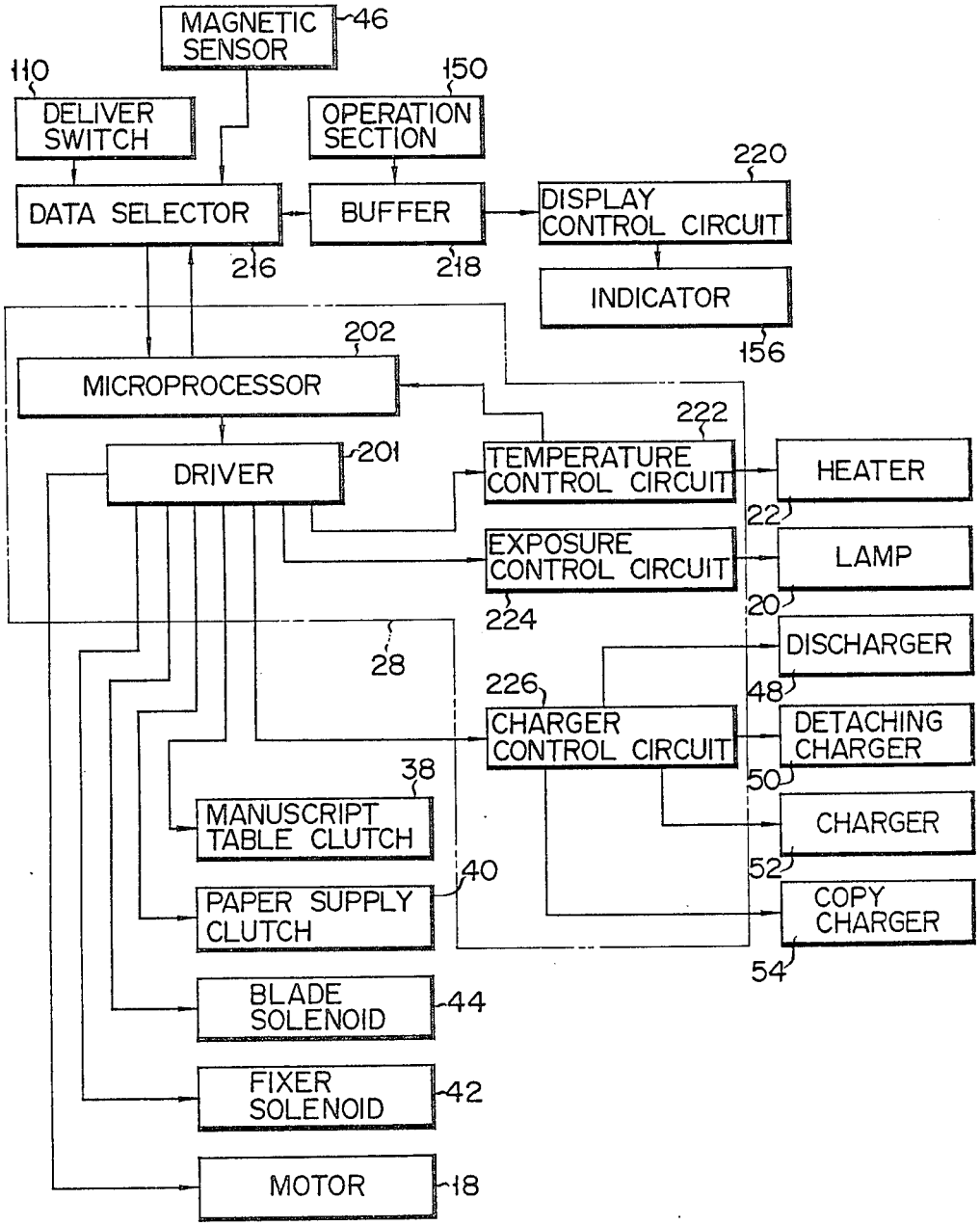
FIG. 9 is a block diagram for explaining the relationship between the control circuit shown in FIG. 1 with the circuits controlled thereby.

FIG. 9 shows the control circuit 28 of the copying machine 70 and circuits controlled thereby.

The control circuit 28 comprises a microprocessor 202, a driver 201 for converting signals from the microprocessor 202 into drive signals, a temperature control circuit 222, an exposure control circuit 224, and a charger control circuit 226.

The delivery switch 110 and the magnetic sensor 46 are connected to the input line of the microprocessor 202 through a data selector 216. The operation section 150 and a display control circuit 220 are also connected to this input line through the data selector 216 and a buffer 218. The display control circuit 220 controls the indicator 156 so that it may indicate desired data.

The temperature control circuit 222, the exposure control circuit 224 and the charger control circuit 226 are connected to the output line of the microprocessor 202 through the driver 201. The manuscript table clutch 38, the paper supply clutch 40, the blade solenoid 44, the fixer solenoid 42 and the motor 18 are connected to the microprocessor 202 through the driver 201.

The temperature control circuit 222 serves to maintain the temperature of the fixer 104 at a temperature which allows fixing of the transferred image. The exposure control circuit 224 controls the operation of the lamp 20 so as to switch it for exposure and to maintain the light output from the lamp 20 constant against voltage fluctuations. The charger control circuit 226 operates the chargers 48 to 54 at predetermined timings.

Figure 10A:
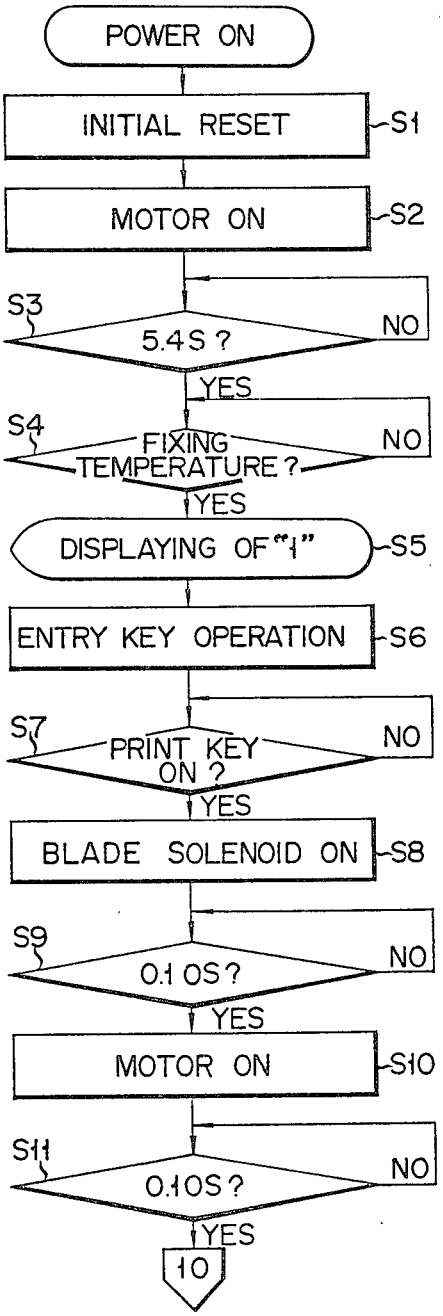
FIGS. 10A and 10B are flowcharts showing the flow of control operation of the control circuit shown in FIG. 1.
Figure 10B:
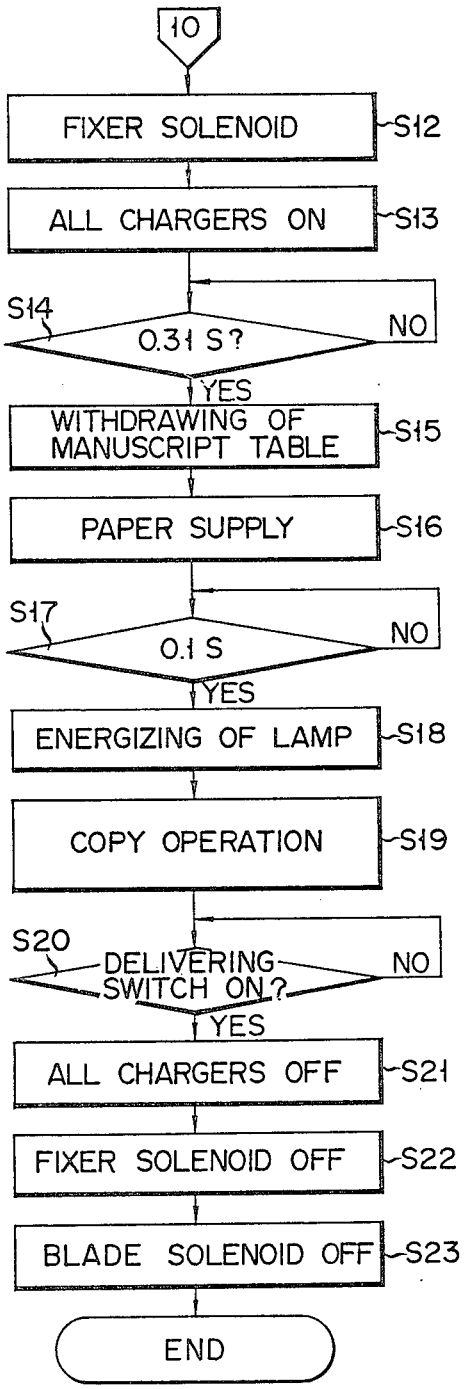

The mode of operation of the power supplying apparatus shown in FIG. 1 will now be described. The control circuit 28 of the power supplying apparatus controls the respective parts according to the flowcharts shown in FIGS. 10A and 10B.

When the switch 12 is closed, the copying machine 70 is ON to power the power supplies 24 and 26. As a result, the control circuit 28 starts operating and supplies reset signals to the respective parts to perform initial reset (step S1.) The respective parts are set in the initial state by the initial reset. The power is also supplied to the heater 22.

The motor 18 is then turned ON (step S2.) In step S2, the conveying path from the paper supply section 74 to the delivery section 76 is actuated to deliver any sheet P which may be left on the conveying path.

The motor 18 is driven for 5.4 seconds (step S3.)

It is discriminated in step S4 if the temperature of the heater 22 has reached a fixing temperature. If YES in step S4, the temperature control circuit 222 supplies a signal representing it to the microprocessor 202.

Then, the microprocessor 202 supplies a control signal to display "1" to the display control circuit 220 through the data selector 216 and the buffer 218. As a result, "1" is displayed by the indicator 156 (step S5.) This indicates that the copying machine 70 is ready for a copying operation.

When the operation section 150 is operated after the copying machine 70 is rendered in this ready state, the copying operation is started (step S6.) The data entered through the keys 154, 158 and 160 is processed by the microprocessor 202 which produces control signals for performing specified operations. For example, when the exposure control key 160 is operated, the microprocessor 202 supplies a control signal to the exposure control circuit 224 through the driver 201 so that the lamp 20 may be lit with a specified intensity.

Figures 11A, 11B, 11C, 11D, 11E, 11F, 11G, 11H:
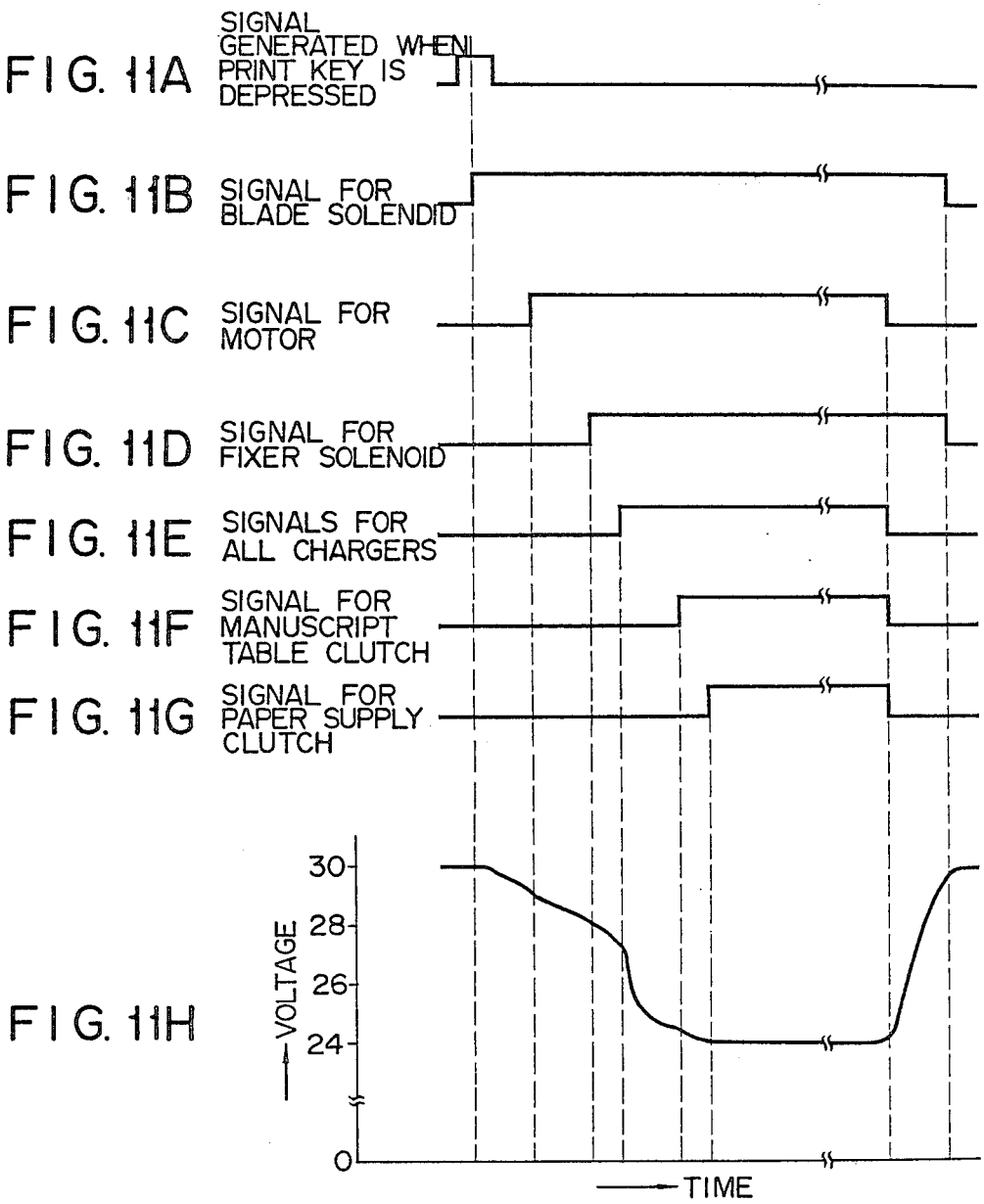
FIGS. 11A to 11H show the signal waveforms for explaining the mode of operation of the power supplying apparatus shown in FIG. 1.

When the print key 152 is depressed in this state (step S7), a signal as shown in FIG. 11A is generated. Upon receiving the signal from the print key 152, the microprocessor 202 supplies a control signal as shown in FIG. 11B through the driver 201 to the blade solenoid 44 to actuate it (step S8). Then, the second power supply 26 supplies a no-load voltage of DC 30 V to the blade solenoid 44. Then a load current of 364 mA flows. As a consequence, at the timing at which the blade 182 is pressed against the photosensitive member 118, the blade solenoid 44 generates an attraction force equivalent to a solenoid of 10 W class. Thus, the blade 182 is securely pressed against and contact with the photosensitive member 118. Therefore, even if a voltage of 30 V is applied on a solenoid of an operating rated voltage of 24 V, no problem will be caused as long as the application of such a voltage is instantaneous and heat generated thereby is relatively small.

When power is supplied to the blade solenoid 44, the output voltage from the second power supply 26 undergoes a slight drop. However, since the attraction operation of the blade solenoid 44 has already been started at this instant, a smaller attraction force than the initial attraction force will suffice to continue the operation. Therefore, such a slight drop in the output voltage may cause no problem.

After 0.1 second elapses (step S9), the microprocessor 202 supplies a control signal as shown in FIG. 11C to the motor 18 via the driver 201 so as to supply power thereto (step S10).

After another 0.1 second elapses (step S11), the microprocessor 202 produces a control signal as shown in FIG. 11D (step S12) to the driver 201 so as to connect the fixer solenoid 42 to the second power supply 26 as a load. Then, the microprocessor 202 further produces a control signal as shown in FIG. 11E to the driver 201 so as to further connect the discharger 48, the detaching charger 50, the charger 52 and the copy charger 54 to the second power supply 26 as loads (step S13).

After 0.31 then elapses (step S14), the microprocessor 202 supplies a control signal as shown in FIG. 11F to the driver 201 so as to further connect the manuscript table clutch 38 to the second power supply 26 as a load (step S15). As a result, the manuscript table clutch 38 is actuated to withdraw the manuscript table 80 for an exposure operation. At this time, the output voltage of the second power supply 26 is substantially the rated voltage of 24 V, as shown in FIG. 11H.

When the preparation for an exposure operation is completed, the microprocessor 202 supplies another control signal as shown in FIG. 11G so as to further connect the paper supply clutch 40 to the second power supply 26 as a load (step S16). Then, the paper supply clutch 40 is actuated and the sheet P is supplied from the paper supply section 74.

After another 0.1 second elapses (step S17), the microprocessor 202 supplies a control signal so as to turn on the lamp 20 (step S18). As the manuscript table 80 advances, the exposure is performed and the copying operation is performed (step S19).

When the copying operation is completed and the copied sheet P is detected by the delivery switch 110 (step S20), the detection signal is supplied to the microprocessor 202. Then, the microprocessor 202 supplies a control signal to the charger control circuit 226 through the driver 201 to deenergize the discharger 48, the detaching charger 50, the charger 52, and the copy charger 54 (step S21). The fixer solenoid 42 is then deenergized (step S22). The blade solenoid 44 is also deenergized to complete the copying operation (step S23).

According to the embodiment described above, a no-load voltage of 30 V from a non-regulated power supply is instantaneously applied to the blade solenoid 44 of an operating rated voltage of 24 V and power consumption of 7 W in the initial period of attraction operation to thereby generate an instantaneous attraction force close to that obtainable with a solenoid of 10 W class. After the initial period of attraction, loads such as the charger 52 are connected to the non-regulated power supply to render its operating voltage 24 V. Thereafter, the blade solenoid 44 is operated at the operating rated voltage of 24 V for attraction of the blade 182. Since a solenoid of 7 W class may be used to obtain an attraction force equivalent to that of a solenoid of 10 W class, the solenoid of smaller size may be used. Furthermore, since the no-load voltage of the non-regulated power supply is utilized to provide a voltage of 30 V, the output capacity and the size of this power supply may be reduced. The rated outputs of the blade solenoid and the non-regulated power supply are reduced, so that heat generated thereby may be reduced to the minimum.

Various changes and modifications may be made within the spirit and scope of the present invention.

What is claimed is:

1. A power supplying apparatus which comprises:

transformer means for converting a high voltage into a low voltage;

non-regulated power supplying means, connected to an output end of said transformer means, for supplying a no-load voltage higher than a full-load voltage;

at least one electromechanical converting means, connected to said non-regulated power supplying means, for instantaneously supplying an output greater than a rated output upon reception of an instantaneous voltage higher than a rated voltage from said non-regulated power supplying means, said at least one electromechanical converting means requiring for its initial operation a mechanical force larger than a mechanical force required in a steady state operation;

at least one load means connected to said non-regulated power supply means; and control circuit means, connected to said output end of said transformer means, for supplying a control signal to said at least one electromechanical converting means so as to connect said at least one electromechanical converting means to said non-regulated power supply means so that the voltage close to the no-load voltage may be instantaneously supplied thereto, said control circuit means then supplying a control signal to said at least one load means so as to further connect said at least one load means to said non-regulated power supply means so that a substantially rated voltage may be supplied to said at least one load means and to said at least one electromechanical converting means.

2. An apparatus according to claim 1, wherein said at least one electromechanical converting means comprises a solenoid so as to convert electricity into a mechanical force.

3. An apparatus according to claim 1, wherein said at least one load means comprises constant voltage power supplies which supply a DC voltage.

4. An apparatus according to claim 1, wherein said at least one load comprises high voltage power supplies which supply a high AC voltage.

5. An apparatus according to claim 1, wherein said at least one electromechanical converting means comprises a plurality of converting means to which are applied voltages close to the no-load voltage of said non-regulated power supply means at different timings, respectively.

* * * * *